United States Patent [19]

Yamada

[11] Patent Number: 4,946,167

[45] Date of Patent: Aug. 7, 1990

[54] GOLF BALL

[75] Inventor: Kaname Yamada, Kakogawa, Japan

[73] Assignee: Sumitomo Rubber Industries, Ltd., Hyogo, Japan

[21] Appl. No.: 315,114

[22] Filed: Feb. 24, 1989

[30] Foreign Application Priority Data

Mar. 3, 1988 [JP] Japan ..... 63-52301

[51] Int. Cl.[5] ..... A63B 37/14

[52] U.S. Cl. ..... 273/232; 40/327

[58] Field of Search ..... 273/232, 235 R, 213; 40/327

[56] References Cited

U.S. PATENT DOCUMENTS 4,772,026 9/1988 Gobush ..... 273/232

FOREIGN PATENT DOCUMENTS 64-15071 1/1989 Japan ..... 273/232

*Primary Examiner*—George J. Marlo

*Attorney, Agent, or Firm*—Birch, Stewart, Kolasch & Birch

[57] ABSTRACT

The disclosure relates to a dimple arrangement of a golf ball in which 10 to 25 dimples of at least two different diameters are arranged in 24 congruent spherical triangles, respectively consisting of two equal sides and divided by the ridge lines of a complete 24-hedron so that the dimple arrangements in the 24 congruent spherical triangles are identical to each other, and one of the great circle paths formed by connecting the ridge lines with each other coincides with a parting line formed by a pair of hemispherical molds.

10 Claims, 6 Drawing Sheets

Fig. 1 (II)

Fig.1 (III)
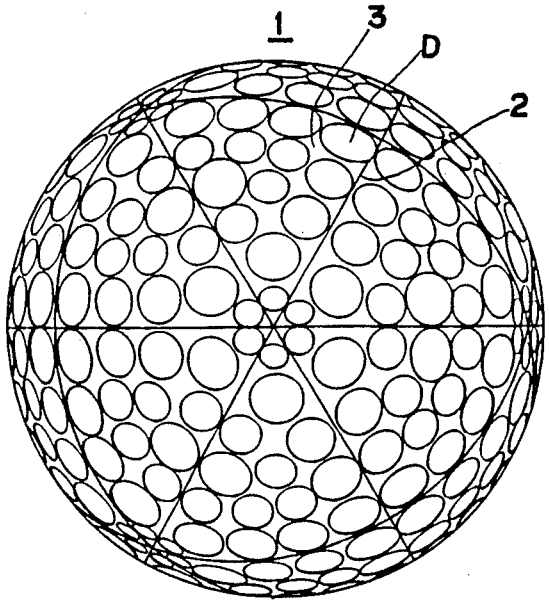
Fig. 2
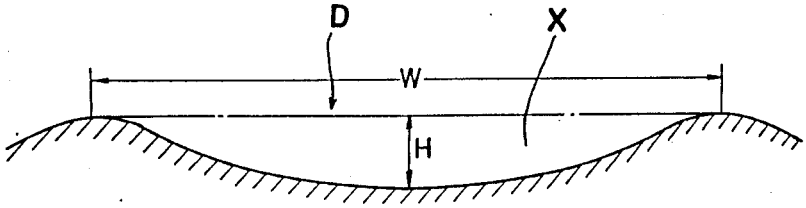

GOLF BALL

BACKGROUND OF THE INVENTION

1. Field of the Invention

The present invention relates to a golf ball, and more particularly, to a golf ball which improves the symmetry of the dimple arrangement of the golf ball so that the golf ball may fly a long distance.

2. Description of the Related Art

Various methods for arranging dimples on the surface of a golf ball are proposed to improve the flying performance of the golf ball. When the golf ball is hit by a golf club, it normally rotates clockwise (backspin) about a certain rotation axis. It is not preferable that the dimples are so arranged as to cause the golf ball to have a strong directionality, i.e., it is not preferable that the configuration of the trajectory of the golf ball is varied depending on rotation axes, namely, by the position at which the golf ball is hit by the golf club. This is caused by the unsymmetrical dimple arrangement of the golf ball.

The symmetry of the dimple arrangement of the golf ball differs a little from that in geometry. This means that divided parts of the spherical surface of the golf ball in which dimples are arranged are congruent with each other. Accordingly, a favorable symmetry means that dimples can be arranged in divided parts which are congruent with each other.

In order to improve the symmetry of the dimple arrangement, heretofore, dimple arrangements are basically performed by dividing the spherical surface of the golf ball into spherical parts corresponding to the face of a regular polyhedron (hereinafter referred to as regular icosahedral arrangement). For example, the following dimple arrangements are proposed.

(a) U.S. Pat. No. 4,560,168

The dimple arrangement is based on a regular icosahedron arrangement. According to the disclosure, the spherical surface of a golf ball is divided into 20 congruent parts in which the dimple arrangement is symmetrical.

(b) U.S. Pat. No. 4,720,111

The dimple arrangement is based on a regular octahedral arrangement. According to the disclosure, the spherical surface of a golf ball is divided into eight congruent parts in which the dimple arrangement is symmetrical.

(c) U.S. Pat. No. 4,142,727

The dimple arrangement is based on a regular dodecahedral arrangement. According to the disclosure, the spherical surface of a golf ball is divided into 12 congruent parts in which the dimple arrangement is symmetrical.

(d) G.B. No. 377,354

The dimple arrangement is based on a right polyhedrons arrangement, including arrangement of up to a regular icosahedron.

(e) G.B. No. 1,407,730

The dimple arrangement is based on a right icosahedron arrangement including 252 pieces of dimple.

It is difficult to allow dimple arrangements to be symmetrical in many divided parts in consideration of a parting line formed when the golf ball is manufactured by a pair of hemispherical molds. Further, dimples are adjusted not to fall on the parting line. Therefore, in the known regular polyhedral arrangement art, a regular icosahedral arrangement is adopted to divide the spherical surface of the golf ball, but the spherical surface thereof cannot be divided more than 20 parts.

SUMMARY OF THE INVENTION

Accordingly, the essential object of the present invention is to provide a golf ball which can be driven a long distance and in the same trajectory irrespective of rotation axes of the golf ball, which can be performed by dividing the surface of the golf ball into more than 20 congruent parts, namely, by increasing symmetrical areas of the spherical surface of the golf ball.

In accomplishing the object, the spherical surface of the golf ball in accordance with the present invention is divided into many congruent spherical triangles. To this end, a complete geodesic 24-hedron is used.

That is, according to the golf ball in accordance with the present invention, 10 to 25 dimples of at least two different diameters are arranged in 24 congruent spherical triangles, respectively consisting of two equal sides and divided by the ridge lines of a complete 24-hedron so that the dimple arrangements in the 24 congruent spherical triangles are identical to each other, and one of the great paths formed by connecting the ridge lines with each other coincides with a parting line formed by a pair of semispherical molds.

In order to improve the symmetry of the dimple arrangement of the golf ball, dimples are arranged inside the respective spherical triangles so as to be in a point or a line symmetrical relationship without intersecting with the ridge lines of the complete geodesic 24-hedron.

The geodesic polyhedron adopted by the present invention is referred to as a spherical polyhedron whose ridges are all geodesic lines. The complete geodesic polyhedron means that the geodesic lines are only complete great circles, namely, circles which encircle the spherical surface and that all the spherical triangles formed thereby are congruent with each other. The complete geodesic polyhedron is formed by projecting dual regular polyhedrons from the center of the circle which circumscribes the regular polyhedrons to the spherical surface of the circle.

The complete geodesic polyhedrons which have 20 congruent spherical triangles or more include a complete geodesic 24-hedron formed by projecting two regular tetrahedrons (A) and (B) shown in FIG. 6-(I) and (II) to the circle (C) which circumscribes them as shown in FIG. 7, a complete geodesic 48-hedron formed by projecting a cube and a regular octahedron as shown in FIG. 8 to the circumscribed circle, and a complete geodesic 120-hedron formed by projecting a regular dodecahedron and a regular icosahedron to the circumscribed circle as shown in FIG. 9.

The complete geodesic 120-hedron divides the spherical surface of a golf ball into 120 congruent spherical triangles. The minimum angle (P) at which adjacent great circles intersect with each other is 36°. Such a small angle (P) is not preferable because dimples of small diameters are arranged in the vicinity of the vertexes of the triangles or great dimple-free areas, namely, great lands are formed in the vertexes. The complete 48-hedron divides the spherical surface of the golf ball into 48 congruent spherical triangles. The minimum angle at which adjacent great circles intersect with each other is 45°, which is not preferable either because similarly to the complete geodesic 120-hedron, dimples of small diameters are arranged in the vicinity of the vertexes of the triangles or great dimple-free areas are formed in the vertexes.

On the other hand, in the case of the 24-hedron, the minimum angle at which adjacent great circles intersect with each other is 60°. Accordingly, dimples whose diameters are more than 2 mm which belongs to a preferable diameter range are arranged in the vicinity of the vertexes of the triangles, i.e., no great dimple-free areas are formed in the vicinity of the vertexes of the triangles. Thus, the complete geodesic 24-hedron is adopted according to the present invention.

As described above, in the golf ball according to the present invention, dimples are arranged in 24 congruent spherical triangles divided by the ridge lines of a complete 24-hedron (maximum number of divided spherical parts in accordance with the prior art is 20). Therefore, the number of symmetrical areas are increased on the spherical surface of the golf ball, whereby the golf ball can be driven a long distance and fly in the same trajectory.

In addition, 10 to 25 dimples are arranged in the 24 divided spherical triangles divided by the ridge lines of the complete 24-hedron so as to be symmetrical in a point or a line relationship. Further, the dimple arrangements in the 24 spherical triangles are identical to each other. This also improves the symmetry of the spherical surface of the golf ball, and in addition, allows the total number of dimples to be arranged on the spherical surface thereof in the range from 240 to 600 which are generally admitted to be preferable.

BRIEF DESCRIPTION OF THE DRAWINGS

The object and feature of the present invention will become apparent from the following description taken in conjunction with the preferred embodiments thereof with reference to the accompanying drawings, in which:

FIG. 2 is a sectional view showing the depth of a dimple;

DETAILED DESCRIPTION OF THE INVENTION

Figure 1:
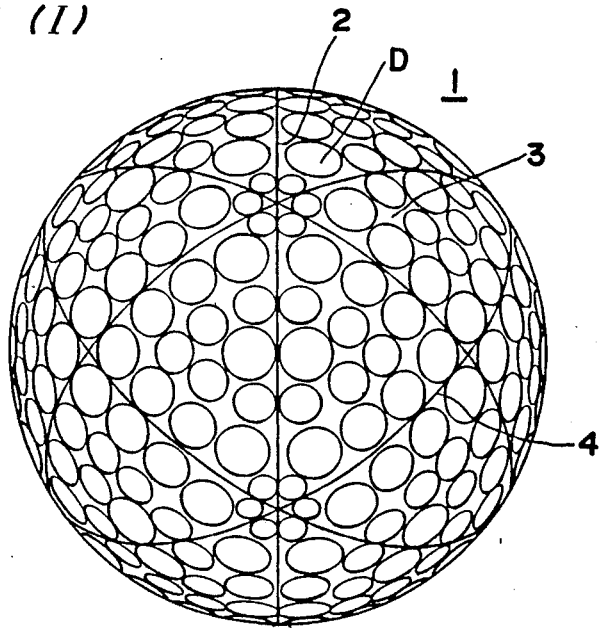
FIGS. 1-(I), 1-(II), and 1-(III) are front views of golf balls, viewed from different directions, of a first embodiment in accordance with the present invention.
Figure 1:
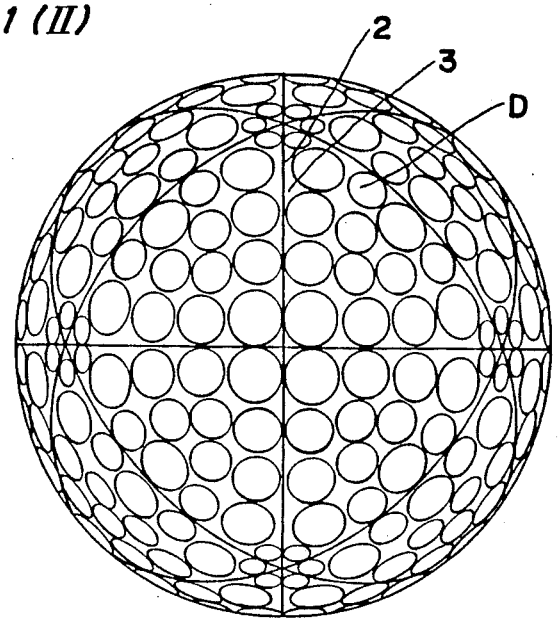
Figure 6I:
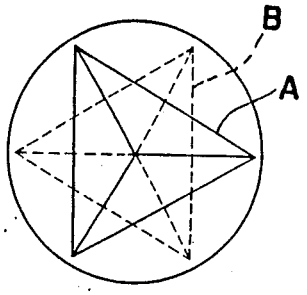
FIGS. 6-(I) and 6-(II) show the method for forming a complete geodesic 24-hedron.
Figure 6:
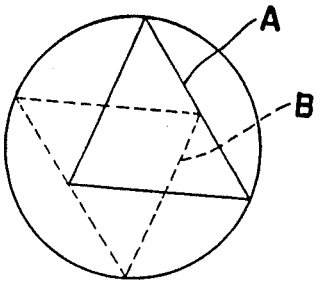
Figure 7:
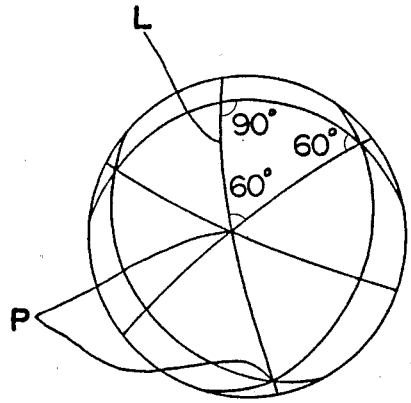
FIG. 7 is a front view showing a complete geodesic 24-hedron.
Figure 8:
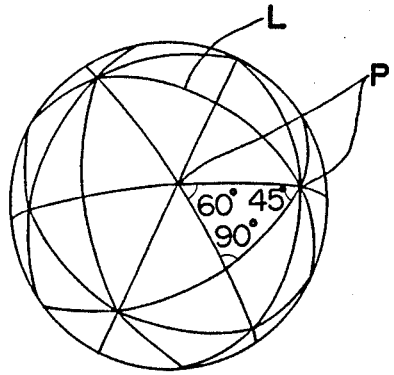
FIG. 8 is a front view showing a complete geodesic 48-hedron.
Figure 9:
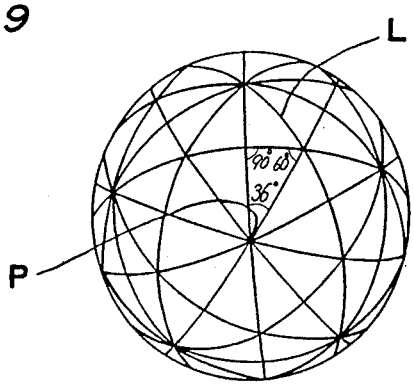
FIG. 9 is a front view showing a complete geodesic 120-hedron.

Referring now to the drawings, there are shown in FIGS. 1-(1), (2), and (3), golf balls 1 according to a first embodiment of the present invention. Dimples (D) formed on the surface of the golf balls 1 are arranged inside 24 congruent spherical triangles 3 divided by phantom lines 2 corresponding to the ridge lines (L) of the complete geodesic 24-hedron shown in FIG. 6. As described above, since all the lines of the complete geodesic polyhedron form great circles, the phantom lines 2 corresponding to the ridge lines form great circles.

The number of the dimples (D) arranged inside the congruent 24 spherical triangles is 10 to 25 substantially in a point or a line relationship, and the dimples (D) are arranged so that they do not intersect with the phantom line 2. The diameters of the dimples (D) arranged in the spherical triangle 3 vary, i.e., the dimples (D) are classified into two or more groups. For example, the diameters of the dimples (D) arranged in the vicinity of points (P) with which all the phantom lines 2 intersect are smaller than those of the dimples (D) arranged in other regions. The dimples are arranged in the identical manner in all of the spherical triangles.

As a golf ball is generally manufactured on the employment of a pair of hemispherical molds, the ridge line (the parting line 4) is designed to correspond to one of the phantom lines which form great circles and not to intersect with the dimples (D).

The number of dimples (D) to be arranged in one spherical triangle 3 ranges from 10 to 25, and favorably, from 12 to 20. In the first embodiment, the number of dimples (D) to be arranged in the respective spherical triangle 3 is 15.

As shown in the drawings, in the first embodiment, the dimples (D) to be arranged in each of the spherical triangles 3 are classified into four groups according to diameters. The following are the diameters of the four groups of the dimples (D) arranged in the respective 24 spherical triangles which compose the surface of the golf ball whose diameter is 42.67 mm and the number of the dimples belonging to the four groups:

| | first group | second group | third group | fourth group |
|---|---|---|---|---|
| diam. mm | 4.4 | 4.0 | 3.4 | 2.2 |
| number | 4 | 4 | 5 | 2 |

Consequently, the total number of dimples (D) arranged in each of the groups is as follows:

| | |
|---|---|
| first group: | 96 dimples |
| second group: | 96 dimples |
| third group | 120 dimples |
| fourth group | 48 dimples |
| Total: | 360 dimples |

Generally, it is preferable that the diameter of the dimples (D) are arranged in one spherical triangle in the range from 2.00 mm to 5.00 mm. It is also preferable that the dimples (D) of two to four different diameters are arranged therein. The reason is as follows: If dimples (D) of a small diameter which are all identical to the diameter of the dimple (D) to be arranged in the vicinity of the vertexes of the spherical triangle 3 are arranged inside the spherical triangle 3, the spherical triangle 3 includes too many dimples (D). On the other hand, if the dimples (D) of a great diameter which are all identical are arranged therein, a great hill is formed in the vicinity of the vertexes of the spherical triangle 3. If dimples of more than four different diameters are arranged therein, the limitation of the diameter to 2.00 mm~5.00 mm does not allow dimples to be differentiated from each other greatly, which is not so efficient for improving the symmetry of the spherical surface of the golf ball.

It is preferable that the dimples (D) of different diameters are arranged as shown in FIG. 1, i.e., the dimples (D) of the same diameter are dispersedly arranged in the spherical triangle 3. It is also preferable that the dimples (D) are arranged symmetrically with respect to a given point or a line in the spherical triangle 3. According to the first embodiment, the dimple arrangements in all of the 24 spherical triangles are identical to each other. Furthermore, supposing that the ridge line (phantom line 2) is the center line, it is preferable that the dimple arrangements in adjacent spherical triangle are symmetrical with respect to the ridge line (phantom line 2).

As shown in FIG. 2, it is preferable that the depth (H) of the dimple (D) ranges from 3% to 9% of the diameter (W) of the dimple (D). The depth (H) of the dimple (D) is 0.18 mm in the first embodiment. Supposing that the region (X) in FIG. 2 indicates the volume of one dimple, the total volume of all the dimples (D) arranged on the golf ball 1 ranges from 250 to 400 $mm^3$.

Figure 3:
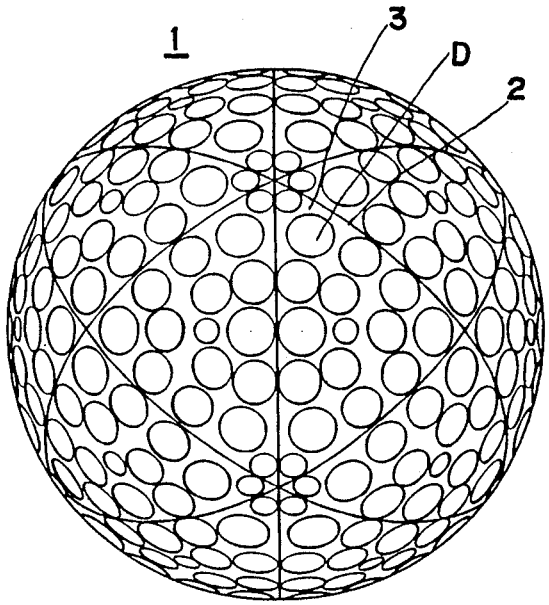
FIGS. 3, 4, and 5 are front views showing golf balls in accordance with second, third, and fourth embodiments of the present invention.
Figure 4:
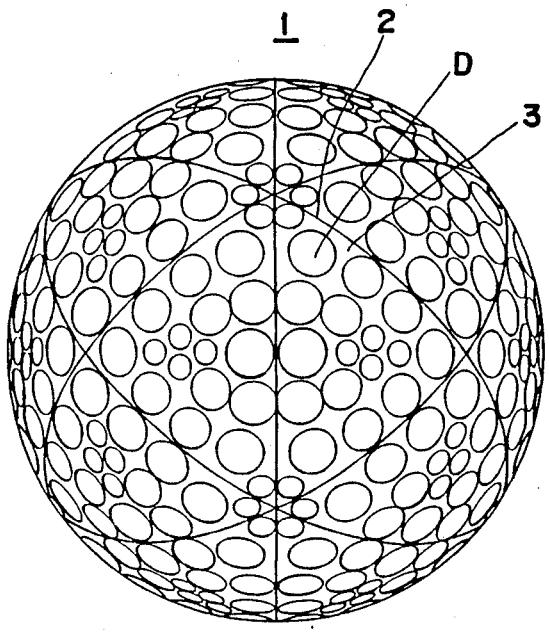
Figure 5:
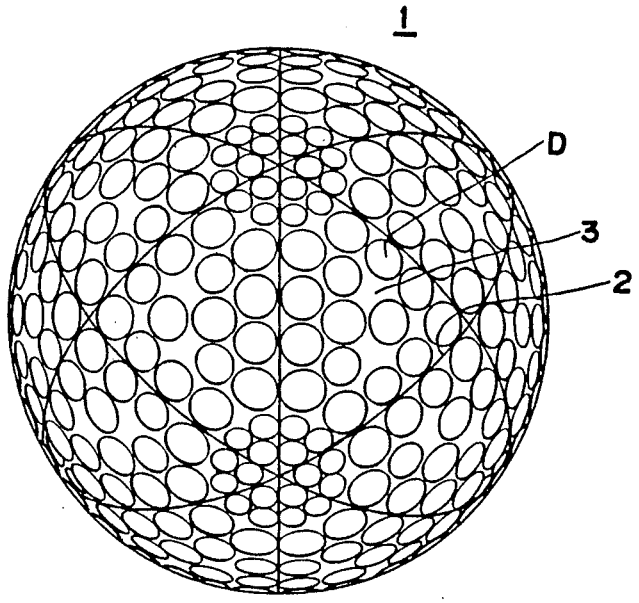

FIG. 3, 4, and 5 show second, third, and fourth embodiments of the present invention, respectively. In these embodiments, each of the spherical surfaces is divided into 24 congruent spherical triangles 3 by the ridge lines of the complete geodesic 24-hedron. Dimples (D) shown in Table 1 are formed in the respective spherical triangles 3 (the item on dimple of the first embodiment is described for comparison.)

As shown in the drawings and Table 1, dimples (D) of four different diameters are arranged in each of the spherical triangles in the range from 10 to 25 pieces in symmetrical relationship with respect to a certain point or a line in the first, second, and third embodiment. Further, dimples of the different diameters are dispersedly arranged in each of the spherical triangles.

TABLE 1

| | dimple parameters | | | | | |
|---|---|---|---|---|---|---|
| | diam. (mm) | depth (mm) | number in a triangle | total | total | total volume ($mm^3$) |
| embodiment 1 | 4.4 | 0.18 | 4 | 96 | | |
| | 4.0 | 0.18 | 4 | 96 | 360 | 356 |
| | 3.4 | 0.18 | 5 | 120 | | |
| | 2.2 | 0.18 | 2 | 48 | | |
| embodiment 2 | 4.0 | 0.20 | 4 | 96 | | |
| | 3.6 | 0.20 | 7 | 168 | 384 | 364 |
| | 3.4 | 0.20 | 2 | 48 | | |
| | 2.2 | 0.20 | 3 | 72 | | |
| embodiment 3 | 4.0 | 0.18 | 4 | 96 | | |
| | 3.6 | 0.18 | 6 | 144 | 432 | 330 |
| | 3.4 | 0.18 | 2 | 48 | | |
| | 2.2 | 0.18 | 6 | 144 | | |
| embodiment 4 | 3.7 | 0.18 | 7 | 168 | | |
| | 3.5 | 0.18 | 2 | 48 | 504 | 366 |
| | 3.3 | 0.18 | 6 | 144 | | |
| | 2.2 | 0.18 | 6 | 144 | | |

The golf balls according to the first through the fourth embodiment are 2-piece golf balls having the core and the cover consisting of the following components:

| (Core) | wt % |
|---|---|
| high cis-polybutadiene | 100 |
| zinc acrylate | 32 |
| antioxidant agent | 0.25 |
| dicumyl dioxide | 1.2 |
| zinc oxide | 20 |

The above mixture is vulcanized at three steps including a first step of for 25 minutes at 145° C., a second step of for five minutes at 150° C. and a third step of for 10 minutes at 165° C.

| (Cover) | wt % |
|---|---|
| Surlyn 1605 (registered Trade Mark of Dupont Company in U.S.A.) | 60 |
| Surlyn 1707 (registered Trade Mark of Dupont Company in U.S.A.) | 35 |
| Surlyn 1706 (registered Trade Mark of Dupont Company in U.S.A.) | 5 |
| titanium dioxide | 2 |
| barium sulfate | 4 |

Urethane paint (30μ thick) was applied to the cover, of the golf balls, which are 2.2 mm thick.

The components of the golf balls and the constructions thereof are not limited to the above-described embodiments. Golf balls having the following components and constructions may also be preferably used. It is favorable that dimples are arranged in the above-described manner on the spherical surface of the golf balls having the components and constructions described above and below.

(1) 1-piece ball formed at 140°~170° C. by graft polymerization of 25~40 wt % of metallic salt of acrylic acid or methacrylic acid is added to 100 wt % of polybutadiene rubber in which cis 1.4 bonding is more than 90% and Mooney viscosity (ML1+4 (100° C.)) is more than 60%.

(2) multi-piece ball formed with one or a multi-layer core containing the above-described golf ball (1) covered with ionomer which is 1.5 mm~2.5 mm thick and 69~73 in Shore D hardness.

(3) multi-piece ball having the same component and construction as the above-described golf ball (2) in which the metal ions of the ionomer consist of sodium and magnesium. (4) rubber-threaded ball formed by winding rubber thread, whose 800% modulus of elasticity is 15~35 kg/$cm^2$, around a solid core center whose diameter is 27~33 mm, and thereafter, the rubber thread is covered with ionomer which is 1.5~2.5 mm thick and 69~73 in Shore D hardness. (5) rubber-threaded ball formed by winding rubber thread, whose 800% modulus of elasticity is 15~35 kg/$cm^2$, around a liquid core center whose diameter is 25~30 mm, and thereafter, the rubber thread is covered with balata which is 1.0~2.0 thick and 75~85 in Shore C hardness.

[Experiment 1]

Figure 10:
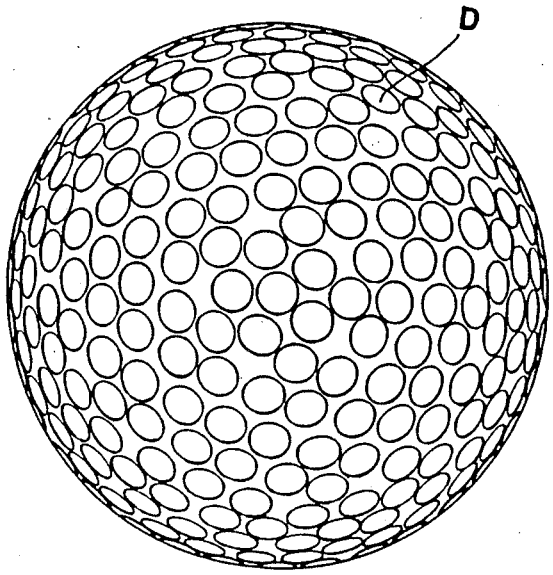
FIG. 10 is a front view showing a golf ball of a prior art icosahedral dimple arrangement.

Golf balls in accordance with the first through fourth embodiment of the present invention were compared with prior art golf balls. Dimples were arranged in 20 congruent spherical triangles formed by a regular icosahedral arrangement as shown in FIG. 10. The construction of the prior art golf balls are the same as those of the golf balls in accordance with the first through fourth embodiment, but the dimples were arranged by a regular icosahedral arrangement according to U.S. Pat. No. 4,560,168. The total number of dimples formed on the prior art golf balls was 432 per golf ball; dimple diameter, 3.43 mm; dimple depth, 0.205 mm; and total volume of the dimples, 411 $mm^3$.

Using the golf balls in accordance with the first through fourth embodiment and the prior art golf balls, tests for comparing the influences which the symmetries of both dimple arrangements give to the configuration of trajectories of the golf balls were conducted. The test is conducted for each group of twenty golf balls to be set in the condition of two kinds with respect to the rotational axis of the golf ball for the pole over pole and poles horizontal of the ball, respectively so as to measure carries, runs, the total (carry plus run) and maximum heights of trajectories. The results are as shown in Table 2. The test is done on the employment of a swing machine manufactured by True Temper Co. of U.S.A. The speed of the head of golf club is 48.8 m/s; assisting wind of 2 m/s; temperature of the golf balls, 23° C. In Table 2, the maximum heights of the trajectories are indicated by the angle of elevation.

TABLE 2

| rotational direction of ball | | (yard) embodiment A | embodiment B | embodiment C | embodiment D | prior art |
|---|---|---|---|---|---|---|
| pole over pole, wherein a golf ball is rotated around its center shaft crossing the mold seam (20 times) | carry | 251.3 | 247.3 | 249.7 | 246.8 | 244.7 |
| | run | 9.5 | 11.9 | 9.4 | 12.7 | 12.4 |
| | total | 260.8 | 259.2 | 259.1 | 259.5 | 257.1 |
| | height | 13.64 | 13.34 | 13.57 | 13.28 | 12.96 |
| poles horizontal, wherein a golf ball is rotated around its center shaft disposed right to a plane including the mold seam (20 times) | carry | 251.8 | 246.5 | 249.3 | 245.1 | 238.2 |
| | run | 10.4 | 12.6 | 10.0 | 13.6 | 17.0 |
| | total | 262.2 | 259.1 | 259.3 | 258.7 | 255.2 |
| | height | 13.55 | 13.28 | 13.44 | 13.10 | 12.45 |

As apparent from Table 2, the test indicates that the difference between the values in the conditions of that the rotational shaft is disposed in pole over pole or poles horizontal according to the embodiments of the present invention was small compared with the difference between the values in the conditions of that the rotational shaft is disposed in pole over pole or poles horizontal of the prior art golf balls. Further, the maximum height of the trajectories of the former was greater than that of the latter. That is, according to the present invention, the configuration of the trajectories of the golf balls are not varied greatly regardless of the positions of the rotational shaft of a golf ball. This is because the spherical surfaces of the golf balls according to the present invention have more congruent spherical triangles, namely, symmetrical areas than the prior art golf balls.

[Experiment 2]

A flight test was conducted with a swing M/C manufactured by True Temper Co. on the golf balls according to the first through fourth embodiment of the present invention and the prior art golf balls used in Experiment 1.

The test conditions were as follows: Driver (loft: 10°) S shaft ABS insert; the head speed, 45 m/s; launch angle of elevation, 10.5°; spin, 3200 RPM; assisting wind of 1~4 m/s; landing spot, green; ball temperature, 23°.

The test result is shown in Table 3. As shown in Table 3, the golf balls in accordance with the present invention were driven further than the prior art golf balls.

TABLE 3

| | first E | second E | third E | fourth E | prior art |
|---|---|---|---|---|---|
| carry | 228 yd | 226 yd | 228 yd | 224 yd | 219 yd |
| run | 18 yd | 21 yd | 22 yd | 22 yd | 21 yd |
| total | 246 yd | 247 yd | 250 yd | 246 yd | 240 yd |

E: embodiment

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf ball having a spherical surface which is divided into a plurality of congruent spherical triangles to form a complete geodesic 24-hedron, 10 to 25 dimples of at least two different diameters arranged in each of the 24 congruent spherical triangles, said spherical surface consisting of two equal sides and divided by the ridge lines or great circle paths of a complete 24-hedron so that the dimple arrangements in each of the 24 congruent spherical triangles are identical to each other, and one of the great circle paths being formed by connecting the ridge lines with each other in coincidence with a parting line formed by a pair of hemispherical molds, wherein at the intersection of 3 great circle zones, 6 dimples, which have diameters in the range of 2.0 to 5.0 mm, are arranged so as to contact each other.

2. The golf ball as defined in claim 1, wherein the dimples are arranged inside the respective spherical triangles so as to establish a line symmetrical relationship without intersecting with the phantom lines of the complete geodesic 24-hedron.

3. The golf ball as defined in claim 1, wherein the minimum angle at which adjacent great circles intersect with each other is 60°.

4. The golf ball as defined in claim 3, wherein all the dimples have diameters of 2.00 to 5.00 mm.

5. The golf ball as defined in claim 1, wherein the dimples include four different types.

6. The golf ball as defined in claim 1, wherein the dimples are arranged to establish a symmetrical relationship within each of the triangles.

7. The golf ball as defined in claim 1, wherein the dimples are arranged in a line of symmetry within each of the triangles.

8. The golf ball as defined in claim 1, wherein 6 dimples having the smallest diameter are arranged at the intersection of the 3 great circle zones so as to contact each other.

9. The golf ball as defined in claim 1, wherein 6 dimples having the smallest diameters are positioned with a plurality of kinds of circular dimples.

10. The golf ball as defined in claim 1, having 240–600 dimples.

* * * * *